United States Patent [19]

Cox

[11] Patent Number: 4,627,206

[45] Date of Patent: Dec. 9, 1986

[54] WINDOW SASH BREATHER DEVICE

[75] Inventor: Timothy B. Cox, Knoxville, Iowa

[73] Assignee: Rollscreen Company, Pella, Iowa

[21] Appl. No.: 775,382

[22] Filed: Sep. 12, 1985

[51] Int. Cl.[4] ..... E06B 7/12

[52] U.S. Cl. ..... 52/302; 52/19; 52/171; 52/304; 98/1

[58] Field of Search ..... 98/1, 29, 90, 97; 52/171, 172, 19, 302, 303, 304

[56] References Cited

U.S. PATENT DOCUMENTS

| | | | |
|---|---|---|---|
| 1,877,685 | 9/1932 | Ottenheimer | 52/172 X |
| 2,276,112 | 3/1942 | Stoneback | 52/172 |
| 4,450,660 | 5/1984 | Dean et al. | 52/172 X |

FOREIGN PATENT DOCUMENTS

| | | | |
|---|---|---|---|
| 504946 | 8/1954 | Canada | 52/172 |
| 1276602 | 10/1961 | France | 52/302 |
| 1226767 | 10/1966 | German Democratic Rep. | 57/171 |

*Primary Examiner*—Harold Joyce

*Attorney, Agent, or Firm*—Zarley, McKee, Thomte, Voorhees & Sease

[57] ABSTRACT

A breather device for use in a vent hole of a double glazed window sash is provided and comprises an elongated hollow sleeve member extending into the vent hole and having opposite interior and exterior ends, and a plurality of resilient fingers extending axially from the exterior end of the sleeve member with each finger terminating in a radially inwardly extending tip portion. The fingers and tip portions of the device are closely spaced so as to inhibit entry of foreign matter into the sleeve and are resilient so as to deflect radially outwardly when a cleaning tool is inserted through the device for removing any foreign matter therein.

13 Claims, 7 Drawing Figures

WINDOW SASH BREATHER DEVICE

BACKGROUND OF THE INVENTION

Many windows are manufactured for high energy efficiency by utilizing dual glazing panels with an insulating air space therebetween. Typically, the interior glazing panel is removable. Such a design requires that the insulating air space be vented to the atmosphere to prevent excessive moisture build-up which results in condensation on the glazing panels. Such ventilation is usually provided by drilling holes through the sash frame and inserting decorative eyelets therein to cover the edges of the holes.

However, these breather holes are subject to failure due to the presence of foreign matter, such as insects and wind borne debris which clog the holes and render them useless. Screens or grills used to cover the holes are unsatisfactory since small insects and debris can still become lodged in the openings of the screen or grill. Also, careless house painting plugs the screen or grill. Furthermore, a fixed screen or grill makes the vent hole much more difficult to clean. Such a vent hole also permits a wooden sash frame to absorb moisture from humid air, and when the air is less humid, the moisture is transferred from the wooden sash to the surrounding dry air, thereby contributing to condensation on the glazing panels.

Therefore, a primary objective of the present invention is the provision of a breather device for use in a window sash vent hole which inhibits entry of foreign matter into the hole and which is easy to clean.

A further objective of the present invention is the provision of a breather device for use in window sash vent holes which permits a cleaning tool to be inserted clear through the hole for cleaning purposes.

Another objective of the present invention is the provision of a breather device for use in a window sash vent hole which prevents a wooden sash frame from absorbing moisture.

Still a further objective of the present invention is the provision of a breather device for a window sash vent hole which utilizes closely spaced resilient fingers on the end of a sleeve extending through the hole to inhibit entry of foreign matter into the hole and to permit easy cleaning of the hole.

An additional objective of the present invention is the provision of a breather device which is economical to manufacture, easy to install, and effective and durable in use.

SUMMARY OF THE INVENTION

The breather device of the present invention is intended for use in a window sash vent hole. More particularly, the window sash includes a sash frame and a pair of glazing panels mounted within the sash frame so as to define an insulating air space therebetween. A vent hole extends through the sash frame for venting the air space to the atmosphere so as to minimize condensation on the glazing panels. The breather device of the present invention comprises an elongated hollow sleeve member extending into the vent hole and having opposite interior and exterior ends. A plurality of resilient fingers extend axially from the exterior end of the sleeve member, with each finger terminating in a radially inwardly extending tip portion. The fingers and tip portions are closely spaced to one another so as to inhibit entry of foreign matter into the sleeve and are resilient so as to deflect radially outwardly when a cleaning tool is inserted through the device for removing any foreign matter therein. A radially outwardly extending flange is provided at the interior end of the breather device to hold the device in position within the vent hole. The breather device is preferably made of plastic material to prevent absorption of moisture into a wooden sash frame.

DETAILED DESCRIPTION OF THE DRAWINGS

Figure 1:
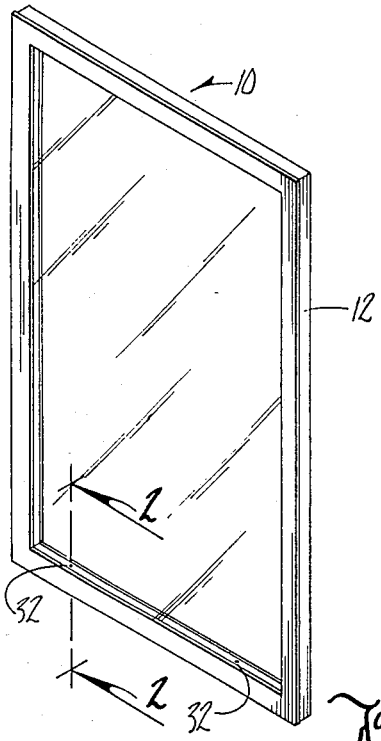
FIG. 1 is a perspective view of a double glazed window sash.

FIG. 1 generally shows a double glazed window sash 10 which includes a sash frame 12 having an interior perimeter surface 14 and an exterior perimeter surface 16. A first glazing panel 18 and a second glazing panel 20 are mounted within sash frame 12 and are spaced apart so as to define an insulating air space 22 therebetween. Preferably, first glazing panel 18 is permanently installed within sash frame 12 while second glazing panel 20 is mounted within a separate frame 24 such that second glazing panel 20 is removably mounted within sash frame 12. A weather seal 26 is provided between frame 24 and sash frame 12. Sash frame 12 may also include a decorative cladding 28, if desired. A vent hole 30 extends through sash frame 12 so as to vent air space 22 to the atmosphere and thereby prevent condensation from forming on glazing panels 18 and 20. The above structure of window sash 10 is conventional and not a part of the present invention.

The present invention concerns a breather device 32 which is mounted within vent hole 30 so as to inhibit entry of foreign matter, such as insects and wind borne debris, into the vent hole and to permit easy cleaning thereof. More particularly, breather device 32 includes an elongated hollow sleeve 34 having an interior end 36 and an exterior end 38. A plurality of closely spaced resilient fingers 40 extend substantially axially from exterior end 38 of sleeve 34, with each finger 40 terminating in a radially inwardly extending tip portion 42. A flange 44 extends radially outwardly from interior end 36 of breather device 32.

Figure 2:
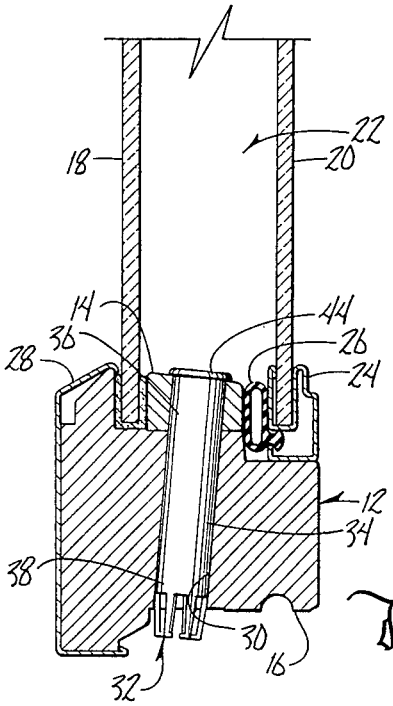
FIG. 2 is a partial sectional view taken along lines 2—2 of FIG. 1.
Figure 3:
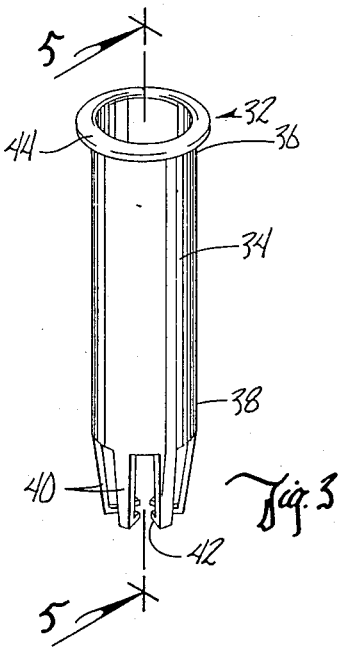
FIG. 3 is a perspective view of the breather device of the present invention.
Figure 4:
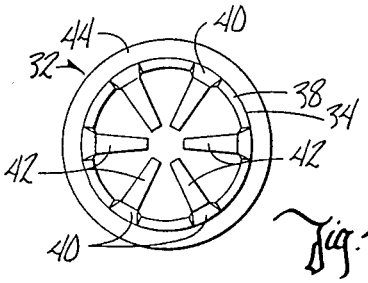
FIG. 4 is a bottom plan view of the breather device of the present invention.
Figure 5:
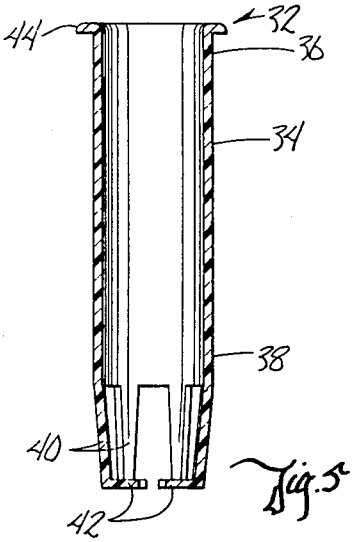
FIG. 5 is a sectional view taken along lines 5—5 of FIG. 3.

Breather device 32 is press-fit within vent hole 30 and held in place by the engagement of flange 44 with interior surface 14 of sash frame 12, as shown in FIG. 2. Sleeve 34 extends into vent hole 30 such that fingers 40 are adjacent exterior perimeter surface 16 of sash frame 12. FIG. 2 shows fingers 40 extending outwardly from exterior perimeter surface 16. An alternative embodiment of the breather device shown in FIG. 7 with similar elements of the alternative embodiment being designated by the same reference numeral, with a "′" added thereto, as used in the embodiment of FIGS. 1–6. In this altnernative embodiment, the length of breather device 32′ is shortened such that tip portions 42′ of the breather device are positioned within the vent hole of sash frame 12.

Figure 6:
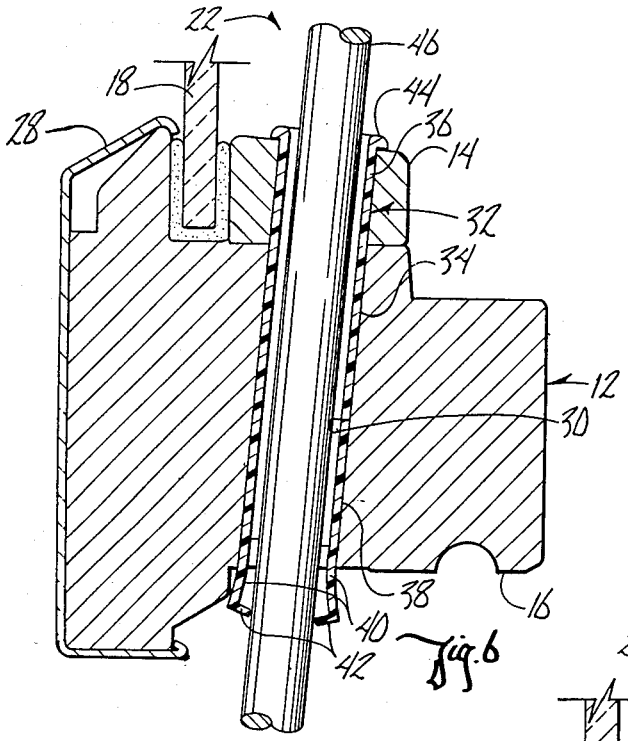
FIG. 6 is an enlarged view similar to FIG. 2 showing how the breather device is cleaned with a cleaning tool.
Figure 7:
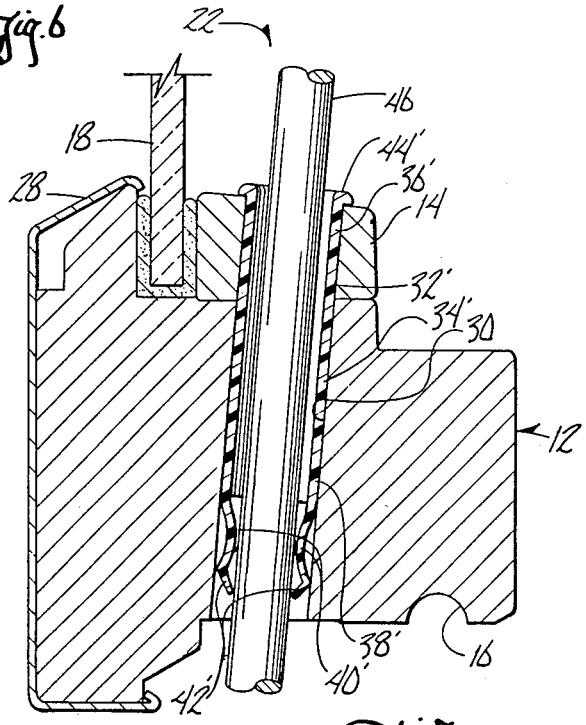
FIG. 7 is a view similar to FIG. 6 showing an alternative embodiment of the breather device.

Fingers 40 are spaced sufficiently close, preferably less than 3/32 inch so as to inhibit the entry of foreign matter into sleeve 34. However, if such foreign matter does enter the sleeve, breather device 32 can be easily cleaned by inserting an elongated narrow cleaning tool 46 through the device. Upon the insertion of tool 46 through the device, fingers 40 and tip portions 42 thereof flex radially outwardly to permit the tool to extnd completely through the device, as seen in FIGS. 6 and 7. Upon removal of the tool, fingers 40 and tip portions 42 return to their normal closely spaced position due to the resilient nature thereof, and thereby inhibit further entry of foreign matter into sleeve 34. The cleaning tool can be any object that will slide within sleeve 34, such as a pencil, a pipe cleaner, or the like.

Preferably, breather device 32 is made of a thermoplastic rubber so as to be resilient and so as to prevent a wooden sash frame from absorbing moisture which could contribute to formation of condensation upon glazing panels 18 and 20.

It is understood that breather device 34 can be used on other structures having vent holes similar to those found on window sash 10.

From the forgoing, it is seen that the present invention accomplishes at least all of its stated objectives.

What is claimed is:

1. In combination with a window sash including a sash frame and a pair of glazing panels mounted within said sash frame so as to define an insulating air space therebetween, said sash frame having a hole extending therethrough for venting said air space to ambient air and thereby minimizing condensation on said glazing panels, a breather device comprising: an elongated hollow sleeve member extending into said hole
and having opposite interior and exterior ends; and a plurality of resilient fingers extending substantially
axially from said exterior end of said sleeve member;
said fingers are provided with tip portions which are closely spaced so as to inhibit entry of foreign matter into said sleeve and being resilient so as to deflect radially outwardly when a cleaning tool is inserted through said device for removing any foreign mattern therein.

2. The combination of claim 1 wherein each of said tip portions extend radially inwardly.

3. The combination of claim 1 wherein said sleeve extends through said hole.

4. The combination of claim 1 wherein said sash frame has interior and exterior perimeter surfaces and said fingers are adjacent said exterior perimeter surface.

5. The combination of claim 4 wherein said breather device further includes a flange extending radially outwardly from said interior end of said sleeve member and engaging said interior perimeter surface of said sash frame thereby maintaining said breather device in position in said hole.

6. The combination of claim 1 wherein said sash frame is made of wood and said breather device is made of thermoplastic rubber, said breather device preventing absorption of moisture by said sash frame.

7. The combination of claim 1 wherein said fingers are normally spaced no more than 3/32 inch apart.

8. A breather device for use in a vent hole comprising:
an elongated hollow sleeve member adapted to extend into said hole and having opposite interior and exterior ends; and
a plurality of resilient fingers extending axially from said exterior end of said member;
said fingers are provided with tip portions which are closely spaced so as to inhibit entry of foreign matter into said sleeve and being resilient so as to deflect radially outwardly when a cleaning tool is inserted through said device for removing any foreign matter therein.

9. The breather device of claim 8 wherein each of said tip portions extend radially inwardly.

10. The breather device of claim 8 wherein said sleeve extends through said hole.

11. The breather device of claim 8 further comprising a flange extending radially outwardly from said interior end of said sleeve for maintaining said device in position with said hole.

12. The breather device of claim 8 wherein said device is made of thermoplastic rubber.

13. The breather device of claim 8 wherein said fingers are normally spaced no more than 3/32 inch apart.

* * * * *